US007694740B2

(12) United States Patent
Mailand et al.

(10) Patent No.: US 7,694,740 B2
(45) Date of Patent: Apr. 13, 2010

(54) COMMUNICATION TOOL AND METHOD FOR A SUBSURFACE SAFETY VALVE WITH COMMUNICATION COMPONENT

(75) Inventors: Jason C. Mailand, The Woodlands, TX (US); Bahr A. Glenn, Cypress, TX (US)

(73) Assignee: BJ Services Company, Houston, TX (US)

( * ) Notice: Subject to any disclaimer, the term of this patent is extended or adjusted under 35 U.S.C. 154(b) by 42 days.

(21) Appl. No.: 12/030,733

(22) Filed: Feb. 13, 2008

(65) Prior Publication Data

US 2008/0196891 A1 Aug. 21, 2008

Related U.S. Application Data

(60) Provisional application No. 60/901,187, filed on Feb. 13, 2007.

(51) Int. Cl.
*E21B 23/00* (2006.01)

(52) U.S. Cl. ..... 166/298; 166/55; 175/284

(58) Field of Classification Search ..... 166/298, 166/381, 55.2, 55, 317, 240; 175/284, 263
See application file for complete search history.

(56) References Cited

U.S. PATENT DOCUMENTS

| | | | | |
|---|---|---|---|---|
| 2,322,695 | A | 6/1943 | Kinzbach | |
| 3,799,258 | A | 3/1974 | Tausch | 166/72 |
| 4,944,351 | A | 7/1990 | Eriksen et al. | 166/376 |
| 4,981,177 | A | 1/1991 | Carmody et al. | 166/376 |
| 5,127,476 | A | 7/1992 | Dickson et al. | 66/323 |
| 5,201,817 | A | 4/1993 | Hailey | 175/269 |
| 5,226,483 | A | 7/1993 | Williamson, Jr. | 166/375 |
| 5,249,630 | A | 10/1993 | Meaders et al. | 166/373 |
| 5,496,044 | A | 3/1996 | Beall et al. | 277/1 |
| 5,564,675 | A | 10/1996 | Hill, Jr. et al. | 251/62 |
| 5,598,864 | A | 2/1997 | Johnston et al. | 137/68.16 |

(Continued)

FOREIGN PATENT DOCUMENTS

| | | |
|---|---|---|
| GB | 2344122 | 5/2000 |

(Continued)

OTHER PUBLICATIONS

PCT Invitation to Pay Additional Fees and Partial Search Report, dated Feb. 9, 2009 for corresponding PCT Serial No. PCT/US2008/053864, filed Feb. 13, 2008.

(Continued)

*Primary Examiner*—Shane Bomar
(74) *Attorney, Agent, or Firm*—Howrey LLP

(57) ABSTRACT

A communication tool apparatus is described which is adapted to provide selective communication of control fluid through a downhole device such as a safety valve. The downhole safety valve is a tubing retrievable subsurface safety valve ("TRSSSV"). The communication tool may be run downhole and within the TRSSSV. Once within the TRSSSV, the communication tool apparatus activates a cutting device within the TRSSSV such that communication of control fluid through the TRSSSV is possible. A replacement safety valve run on a wireline may then be inserted into the TRSSSV and be operated via the control fluid line, as a new communication path created by the communication tool described herein. A method of using the communication tool apparatus is also described.

24 Claims, 14 Drawing Sheets

U.S. PATENT DOCUMENTS

| | | | | |
|---|---|---|---|---|
| 5,799,949 | A | 9/1998 | Beall et al. | 277/1 |
| 6,260,850 | B1 | 7/2001 | Beall et al. | 277/314 |
| 6,283,477 | B1 | 9/2001 | Beall et al. | 277/314 |
| 6,352,118 | B1 | 3/2002 | Dickson et al. | 166/373 |
| 6,523,614 | B2 | 2/2003 | Dennistoun et al. | 166/375 |
| 6,659,185 | B2 | 12/2003 | Dennistoun et al. | 166/375 |
| 6,742,595 | B2 | 6/2004 | Dennistoun et al. | 166/375 |
| 6,880,641 | B2 | 4/2005 | Dennistoun et al. | 166/375 |
| 6,902,006 | B2 * | 6/2005 | Myerley et al. | 166/373 |
| 7,188,674 | B2 | 3/2007 | McGavern, III et al. | 166/298 |
| 7,249,635 | B2 | 7/2007 | Dennistoun et al. | 166/373 |
| 7,475,733 | B2 | 1/2009 | Dennistoun et al. | 166/373 |
| 2002/0150436 | A1 | 10/2002 | Mason et al. | 409/143 |
| 2002/0153139 | A1 | 10/2002 | Dennistoun et al. | 166/298 |
| 2003/0234104 | A1 | 12/2003 | Johsnton et al. | 166/298 |
| 2005/0056414 | A1 | 3/2005 | Dennistoun et al. | 166/55.7 |
| 2005/0056430 | A1 | 3/2005 | Dennistoun et al. | 166/321 |
| 2005/0098210 | A1 | 5/2005 | Strattan et al. | 137/70 |
| 2005/0098325 | A1 | 5/2005 | Myerley et al. | 166/386 |

FOREIGN PATENT DOCUMENTS

| | | |
|---|---|---|
| GB | 2392688 | 3/2004 |
| WO | WO 2005/045180 | 3/2005 |

OTHER PUBLICATIONS

PCT International Search Report and Written Opinion, dated Apr. 15, 2009 for corresponding PCT Serial No. PCT/US2008/053864, filed Feb. 13, 2008.

PCT International Search Report and Written Opinion dated Jul. 3, 2008, for corresponding PCT/US2008/053863.

PCT International Preliminary Report on Patentability dated Dec. 10, 2009, for corresponding PCT/US2008/053863, filed Feb. 13, 2008.

* cited by examiner

COMMUNICATION TOOL AND METHOD FOR A SUBSURFACE SAFETY VALVE WITH COMMUNICATION COMPONENT

PRIORITY

This application claims the benefit of U.S. Provisional Application No. 60/901,187, filed on Feb. 13, 2007, entitled "COMMUNICATION TOOL FOR SUBSURFACE SAFETY VALVE WITH COMMUNICATION DEVICE," which is hereby incorporated by reference in its entirety.

FIELD OF THE INVENTION

The present invention relates to the drilling and completion of well bores in the field of oil and gas recovery. More particularly, this invention relates to an apparatus to provide selective communication of control fluid through a downhole tool, such as a safety valve. A method of using the communication tool apparatus is also described.

DESCRIPTION OF THE RELATED ART

In the oil and gas industry, a production tubing string is typically run thousands of feet into a well bore. Generally, when running a tubing string downhole, it is desirable—and in some cases required—to include a safety valve on the tubing string. The safety valve typically has a fail safe design whereby the valve will automatically close to prevent production fluid from flowing through the tubing, should, for example, the surface production equipment be damaged or malfunction.

Should the safety valve become inoperable, the safety valve may be retrieved to surface by removing the tubing string, as described hereinafter. The tubing retrievable subsurface safety valve ("TRSSSV") may be a flapper-type safety valve, a ball-seat type of valve, or other types of valves known in the art. The TRSSSV is attachable to production tubing string and generally comprises a flapper pivotally mountable on the lower end of the safety valve assembly by a flapper pin, for example. A torsion spring is typically provided to bias the flapper in the closed position to prevent fluid flow through the tubing string. When fully closed the flapper seals off the inner diameter of the safety valve assembly preventing fluid flow therethrough.

A flow tube is typically provided above the flapper to open and close the flapper. The flow tube is adapted to be movable axially within the safety valve assembly. When the flapper is closed, the flow tube is in its uppermost position; when the flow tube is in its lowermost position, the lower end of the flow tube operates to extend through and pivotally open the flapper. When the flow tube is in its lowermost position and the flapper is open, fluid communication through the safety valve assembly is allowed.

A rod piston contacts the flow tube to move the flow tube. The rod piston is typically located in a hydraulic piston chamber within the TRSSSV. The upper end of the chamber is in fluid communication, via a control line, with a hydraulic fluid source and pump at the surface. Seals are provided such that when sufficient control fluid (e.g. hydraulic fluid) pressure is supplied from surface, the rod piston moves downwardly in the chamber, thus forcing the flow tube downwardly through the flapper to open the valve. When the control fluid pressure is removed, the rod piston and flow tube move upwardly allowing the biasing spring to move the flapper, and thus the valve, to the closed position.

On relatively rare occasions, the safety valve assembly may become inoperable or malfunction due to the buildup of materials such as paraffin, fines, and the like on the components downhole, e.g., such that the flapper may not fully close or may not fully open. Regardless, it is known to replace the TRSSSV by retrieving the safety valve assembly to surface by pulling the entire tubing string from the well and replacing the safety valve assembly with a new assembly, and then rerunning the safety valve and the tubing string back into the well.

Because of the length of time and expense required for such a procedure, it is known to run a replacement safety valve downhole within the tubing retrievable safety valve as described hereinafter. These replacement safety valves typically are run downhole via a wireline. Thus, these replacement safety valves are often referred to as wireline retrievable sub-surface safety valves ("WRSSSV"). Before inserting the wireline safety valve into the TRSSSV assembly, however, two operations are performed. First, the TRSSSV is locked in its open position (i.e., the flapper must be maintained in the open position); and second, fluid communication is established from the existing control fluid line to the interior of the TRSSSV, thus providing control fluid (e.g. hydraulic fluid) to the replacement wireline safety valve. Lockout tools perform the former function; communication tools perform the latter.

Various lockout tools are commercially available, and will not be further discussed herein. When it is desired to lock the safety valve assembly in its open position, the lockout tool is lowered through the tubing string and into the safety valve. The lockout tool is then actuated to lock the valve mechanism (e.g. the flapper) of the TRSSSV in the open position.

Before inserting the replacement safety valve or WRSSSV, communication is established between the hydraulic chamber of the TRSSSV and the internal diameter of the TRSSSV. The communication tool disclosed herein may be utilized to provide fluid communication between the inner diameter of the safety valve and the hydraulic chamber, so that the hydraulic control line from surface can be utilized to operate the replacement wireline safety valve.

Once communication has been established with the hydraulic line, the WRSSSV may be run downhole. The WRSSSV may resemble a miniature version of the TRSSSV assembly described above. The WRSSSV is adapted to be run downhole and placed within the inner diameter of the TRSSSV assembly described above. The WRSSSV typically includes an upper and lower set of seals that will straddle the communication flow passageway established by the communication tool so that the control line to the TRSSSV may be used to actuate the valve mechanism of the WRSSSV.

More specifically, the seal assemblies allow control fluid from the control line to communicate with the hydraulic chamber and piston of the WRSSSV in order to actuate the valve of the WRSSSV between the open and closed positions. Once the WRSSSV is in place, the wireline may be removed and the tubing string placed on production.

There are various methods of establishing communication used today. One such method involves inserting a communication tool downhole which must be radially aligned just right in order for the cutter to cut the required communication point. Some of these tools require special sleeves which precisely position the communication tool in exact alignment.

There are disadvantages to these designs. If the alignment is off, the cutter will miss the intended communication point and communication will not be established. This may also lead to costly damage to the interior of the tool. Also, designing and installing the sleeves used to align the tools is costly and may introduce unnecessary leak paths in the tubing.

In view of the foregoing, there is a need in the art for, among others, a cost effective communication tool which establishes fluid communication without the need for alignment of the tool or the costly components associated therewith.

SUMMARY OF THE INVENTION

According to one embodiment, the invention relates to an apparatus for establishing communication between a control fluid line from surface to the inner diameter of a downhole tool such as a safety valve. In a preferred embodiment, a communication device is provided to establish fluid communication between the control line and the inner diameter of a safety valve. Should a need arise where it is necessary to establish fluid communication between the control line and the interior of the safety valve (e.g., if the TRSSSV is no longer operable), an embodiment of a communication tool may be run into the safety valve. At a predetermined point, a cutter extends from the tool and will ultimately penetrate through a communication component in the TRSSSV. The communication component is installed in, and extends from, the non-annular hydraulic piston chamber of the TRSSSV. When the cutter is above the communication component, application of a downward force causes the cutter to axially penetrate the communication component, thereby establishing communication between the control line and the inner diameter of the safety valve. A wireline replacement valve may then be run downhole, and operated utilizing the control line to surface.

According to a preferred embodiment, the cutter of the communication tool does not have to be axially aligned with the communication component of the TRSSSV prior to actuating the communication tool. The cutter is extended from the communication tool once the tool has been locked into position inside the TRSSSV. The cutter extends into an internal recess on the inner diameter of the TRSSSV. With the cutter in the extended position, downward jarring on the central prong of the tool causes downward displacement of the cutter. A return spring and indexing spring combine to cause the cutter to rotate a pre-selected amount when the jarring weight is removed from the central prong. Following rotation, jarring is commenced again. The cutter will rotate through 360 degrees with continued jarring and rotating steps. The cutter will contact the communication component at least once per complete revolution.

Figure 1:
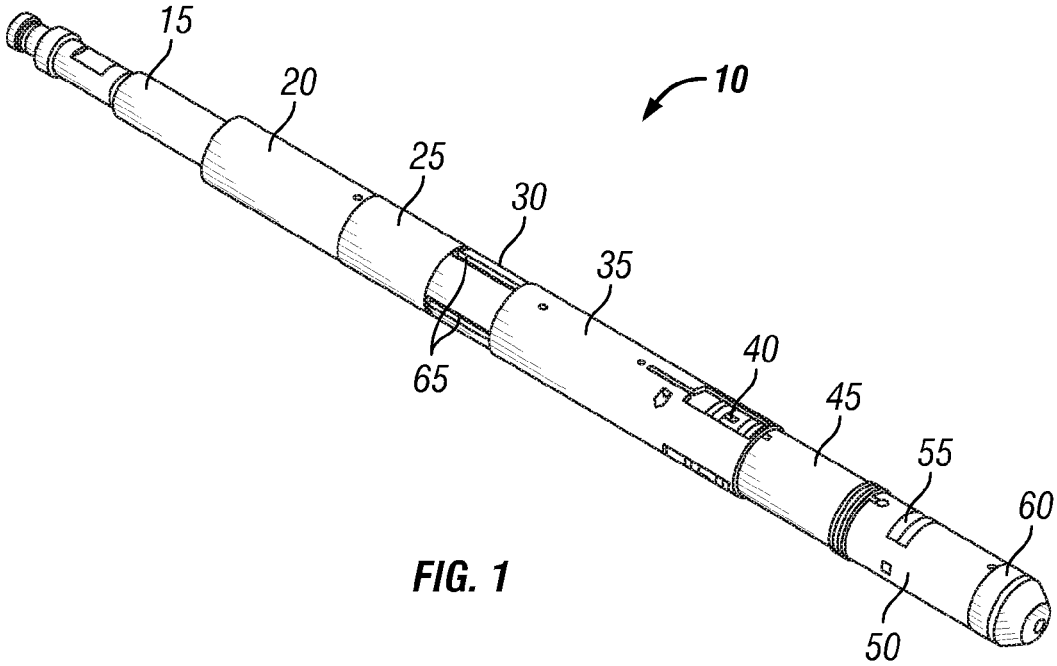
FIG. 1 shows a communication tool in the running mode according to an exemplary embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF PREFERRED EMBODIMENTS

Illustrative embodiments and related methods of the invention are described below as they might be employed in the oil and gas well. In the interest of clarity, not all features of an actual implementation are described in this specification. It will of course be appreciated that in the development of any such actual embodiment, numerous implementation-specific decisions must be made to achieve the developers' specific goals, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and methods of the invention will become apparent from consideration of the following description and drawings.

Embodiments of the invention will now be described with reference to the accompanying figures. Like numbers refer to like elements throughout.

Figure 7A:
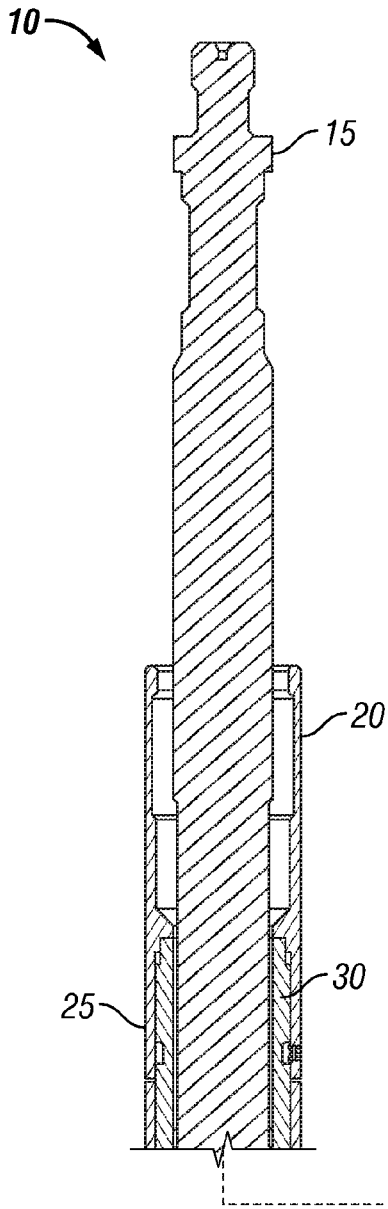
FIGS. 7A-7D show a sectional view of a communication tool in the running position after it has landed in a TRSSSV according to an exemplary embodiment of the present invention.
Figure 7B:
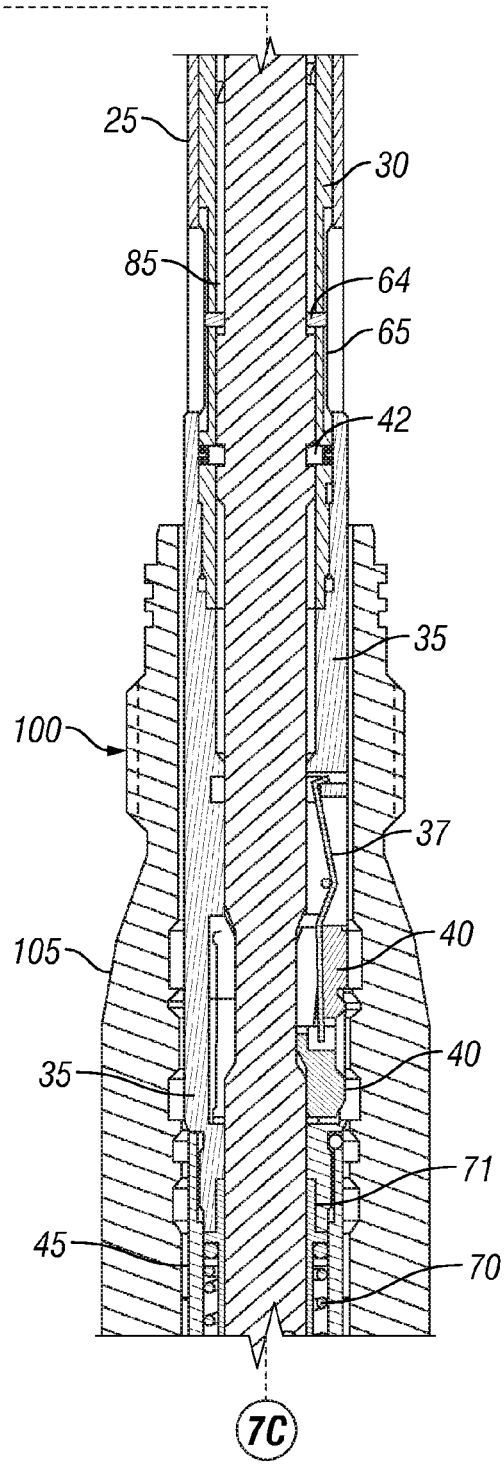

FIG. 1 illustrates the communication tool 10 in the running mode according to an exemplary embodiment of the present invention. In this position, the central prong 15 is secured from axial movement by one or more shear pins 42 (shown in FIG. 7B). In this mode, the cutter 55 is retracted and the lock dogs 40 can radially seek the appropriate lock profile in the tubing retrievable subsurface safety valve. As shown in FIG. 1, the communication tool according to one embodiment comprises an upper housing 20, ratchet sleeve 25, indexing body 30, lock body 35, return spring adapter 45, cutter housing 50 and nose 60. Ratchet springs 75 (shown in FIG. 5A) are mounted inside ratchet sleeve 25. Indexing body 30 houses indexing springs 65 and ratchet springs 75, the operations of the indexing springs and ratchet springs being more fully described below. Extending from the indexing body 30 is lock body 35 which houses lock dogs 40 for locking the communication tool in a mating lock profile in the TRSSSV. A return spring adapter 45 extends from the lock body 35 and contains return spring 70 (shown in FIGS. 4A & 4B). A cutter housing 50 is connected to the lower end of return spring adapter 45 and contains cutter 55. The communication tool 10 may include a nose 60 connected to the lower end of cutter housing 50, wherein the nose includes a tapered profile for guiding the tool through a production tubing and the TRSSSV.

Figure 2:
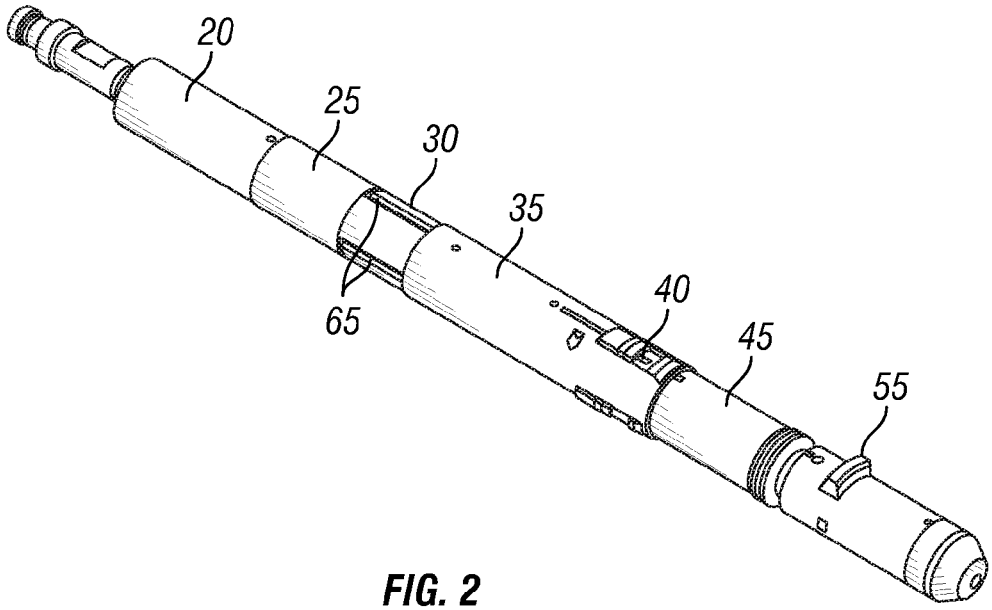
FIG. 2 shows the communication tool of FIG. 1 in the jarring mode.

FIG. 2 illustrates an exemplary embodiment of the communication tool in the jarring mode. In the jarring mode, central prong 15 has been forced down, axially extending the cutter housing 50 and the cutter 55 in order to cut into an exposed communication component in the TRSSSV. When the weight bar (not shown) is picked up again, an internal return spring 70 returns the central prong 15, cutter housing 50, cutter 55, and nose 60 to a pre-jarred state (as shown in FIG. 1). During the return, an integral indexing system rotates the central prong 15, cutter housing 50, cutter 55 and nose 60 45 degrees counterclockwise for another jarring hit. For purposes of this disclosure, the terms indexing and rotating are used interchangeably to denote rotating the cutter 55 a fixed amount around the axis of the communication tool 10. One of skill in the art having the benefit of this disclosure will recognize that the indexing system could rotate the central prong 15, cutter housing 50, cutter 55 and nose 60 any desired amount, either clockwise or counterclockwise as may be desired.

Figure 3E:
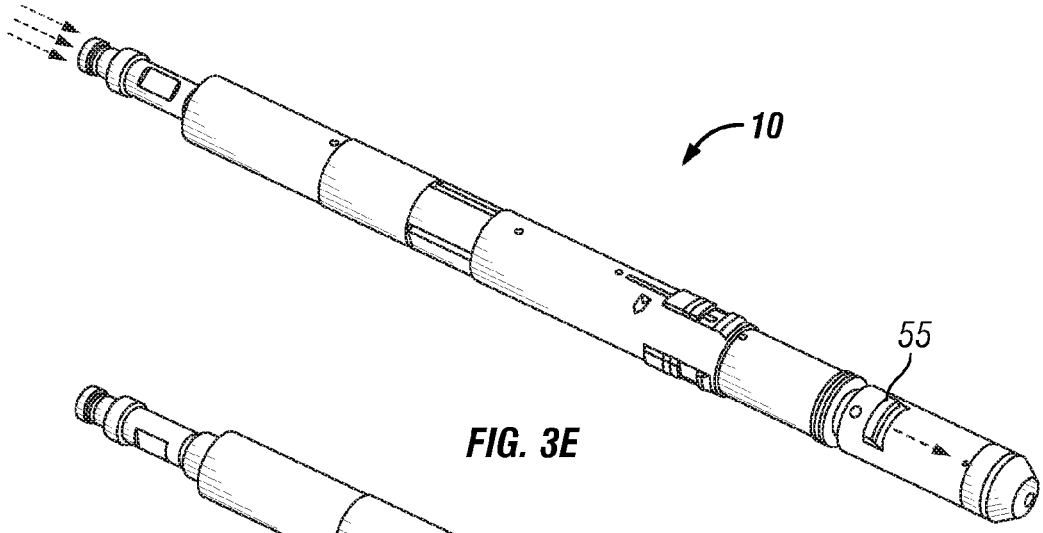
FIGS. 3A-3H show the communication tool of FIG. 1 in various modes, including the first 90 degrees of the available 360 degrees of rotation of the tool.
Figure 3F:
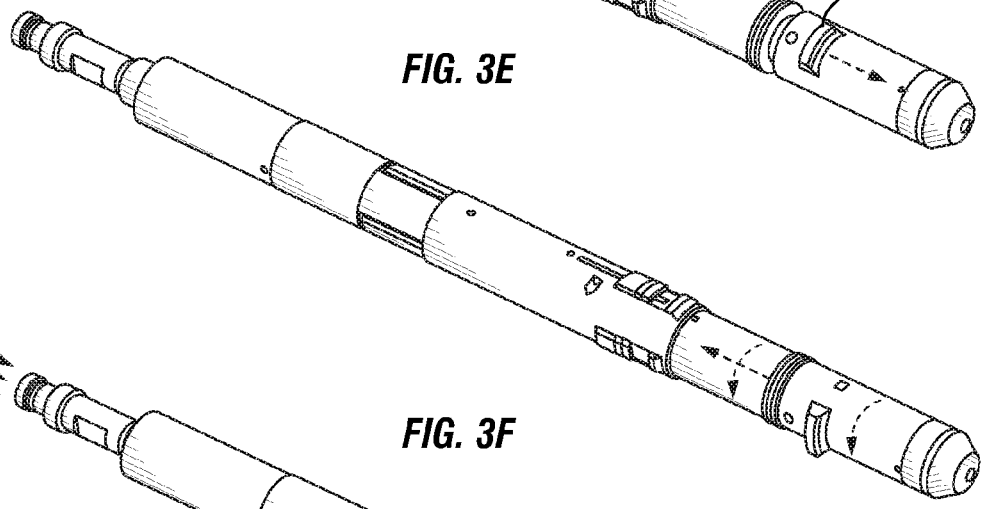
Figure 3G:
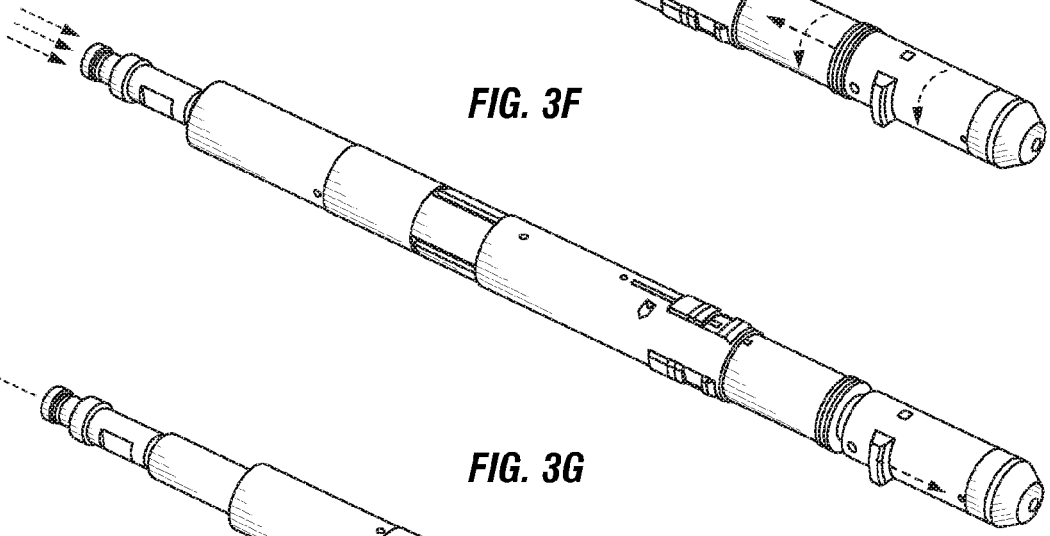
Figure 3H:
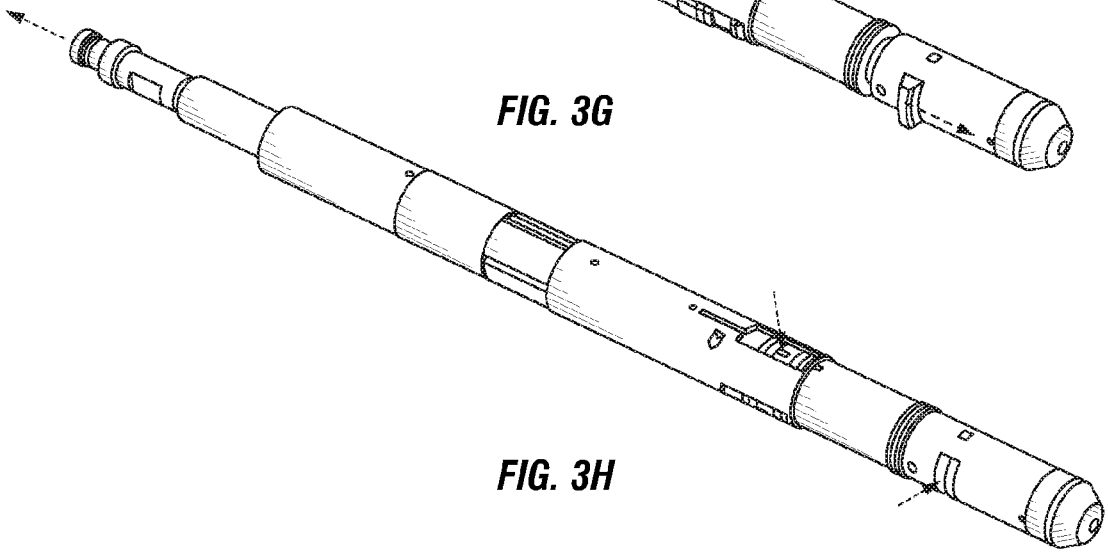
Figure 3A:
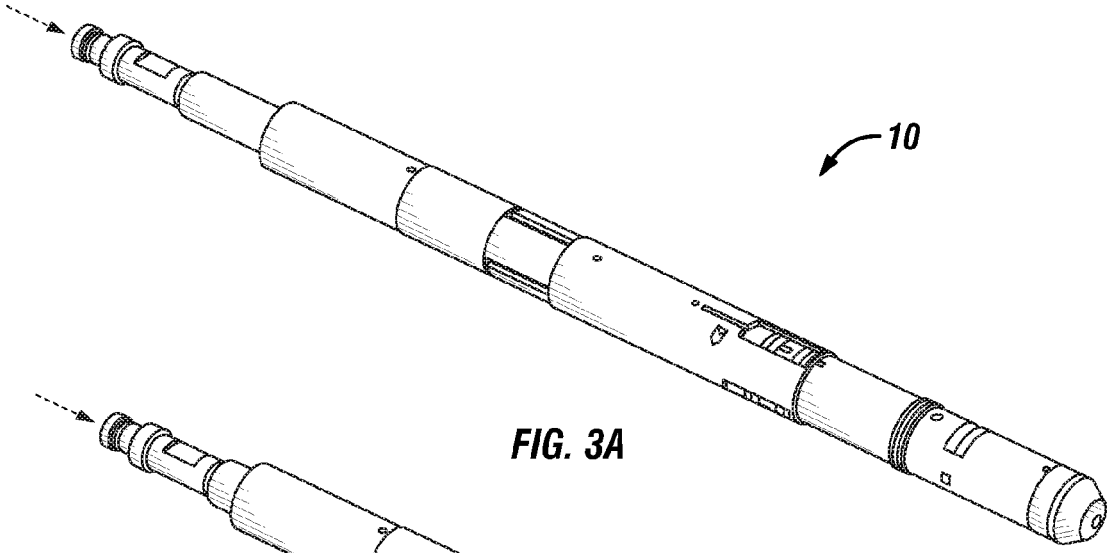
Figure 3B:
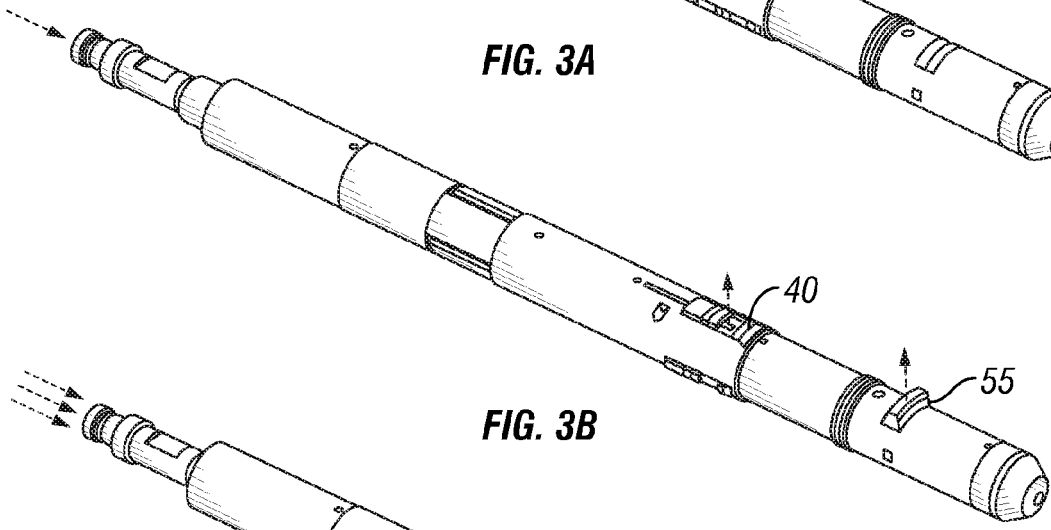
Figure 3C:
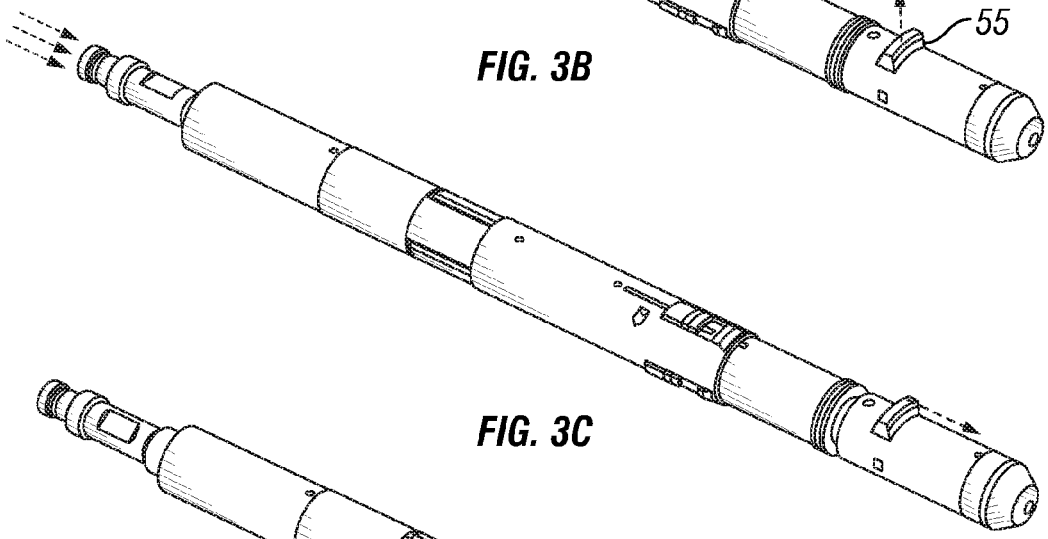
Figure 3D:
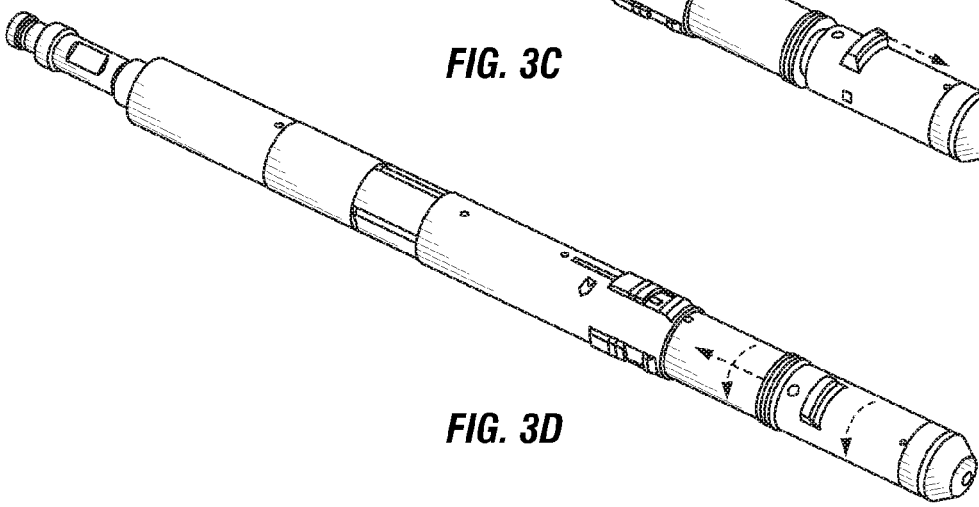

FIGS. 3A-3H illustrate the first 90 degrees of the available 360 degrees of possible rotation for the cutter of communication tool 10. FIG. 3A illustrates the communication tool 10 while running in the well. FIG. 3H illustrates the communication tool 10 being pulled out of the well after establishing communications with the locking dogs and cutter retracted. FIG. 3B illustrates the lock dogs 40 being extended radially to lock communication tool 10 relative to the TRSSSV and to extend the cutter 55 for establishing communications. FIGS. 3C-3G illustrate the jarring/rotating steps. More particularly, FIGS. 3C, 3E and 3G illustrate the communication tool 10 being jarred downwardly, each figure showing cutter 55 rotated 45 degrees from the previous jarring position. FIGS. 3D and 3F show the cutter rotated 45 degrees from its prior position. In a preferred embodiment, the cutter 55 is extended throughout the jarring phase of operation. The return spring and indexer rotate the cutter relative to the safety valve. In the illustrated embodiment, the lower portion of the communication tool 10 will rotate through 360 degrees with continued jarring. The cutter 55 will contact the communication component of the TRSSSV at least once per complete revolution (or, for example, 8 jarring licks in the illustrated embodiment).

Figure 4A:
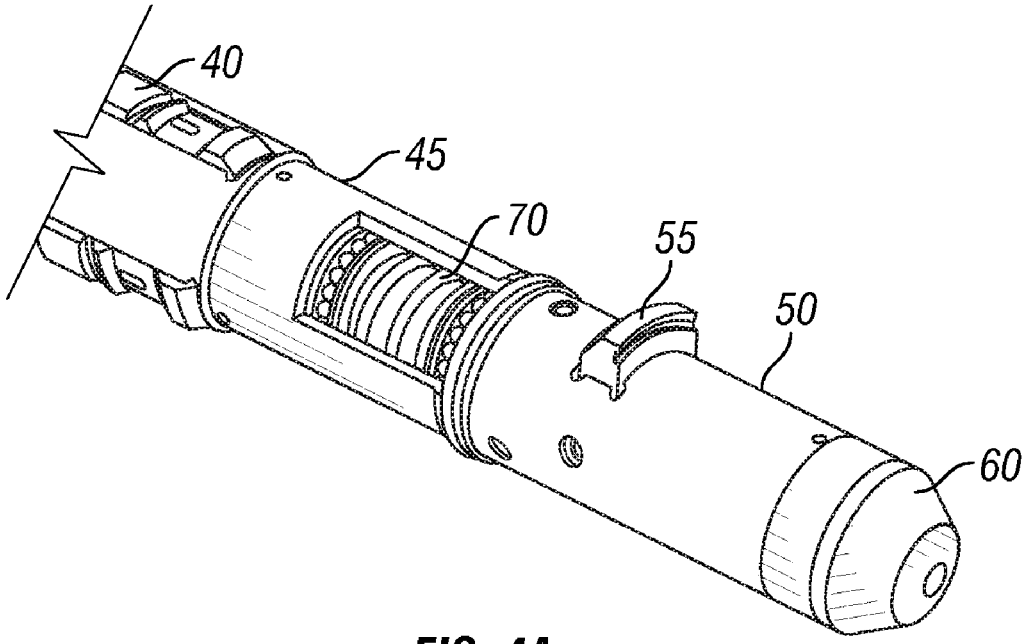
FIGS. 4A and 4B are enlarged views of the cutter, cutter housing, and return spring for the communication tool of FIG. 1.
Figure 4B:
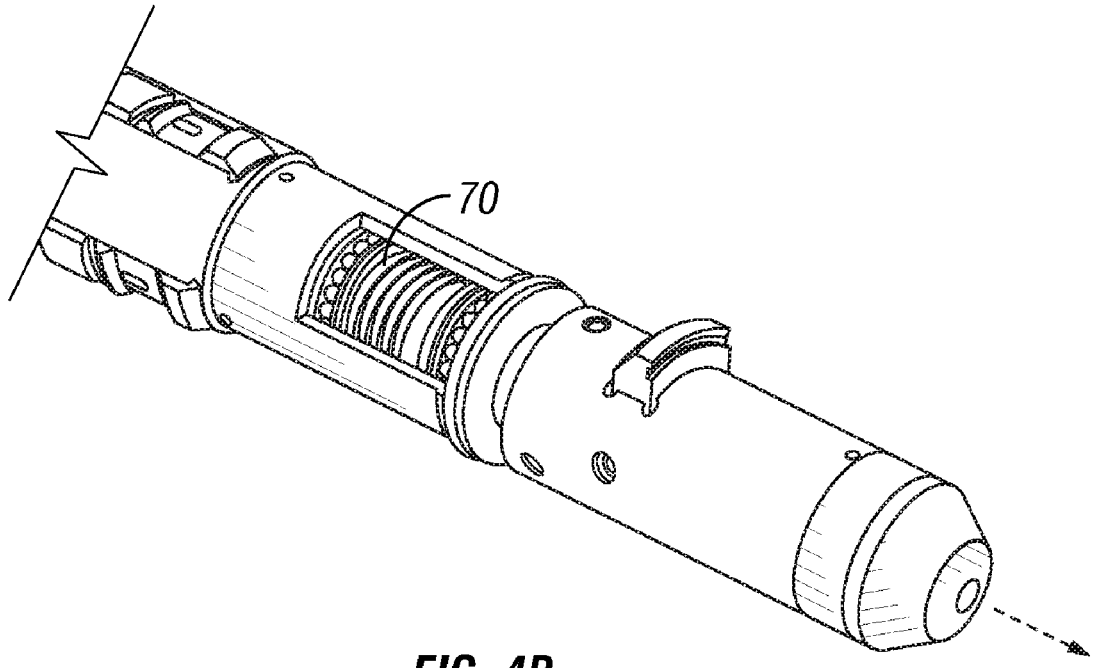
Figure 5A:
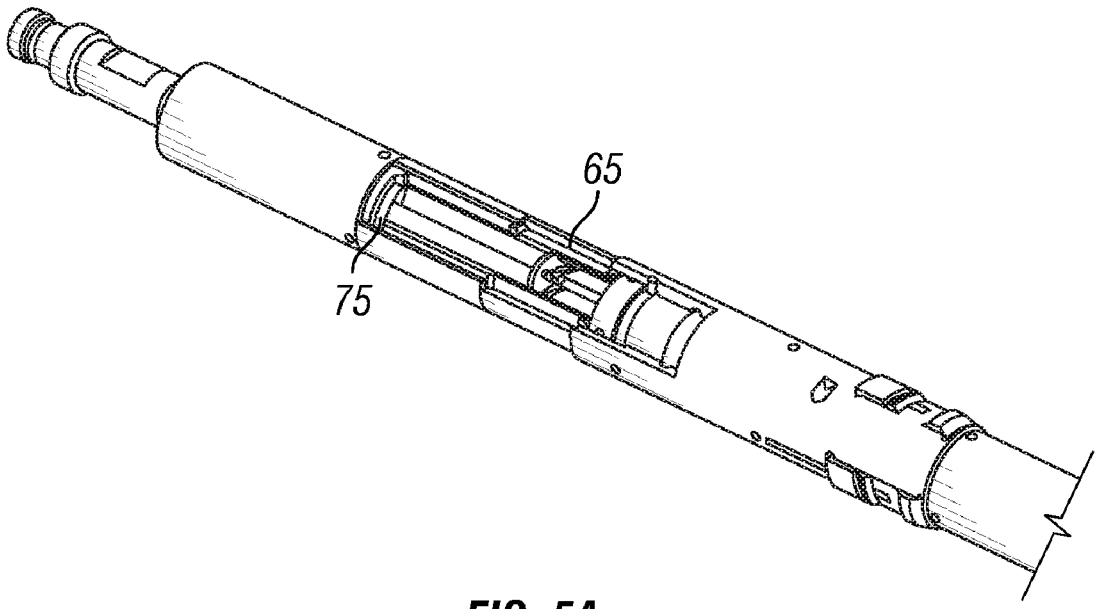
FIGS. 5A and 5B show a partial cutaway view of the ratchet springs and index springs of the communication tool of FIG. 1.
Figure 5B:
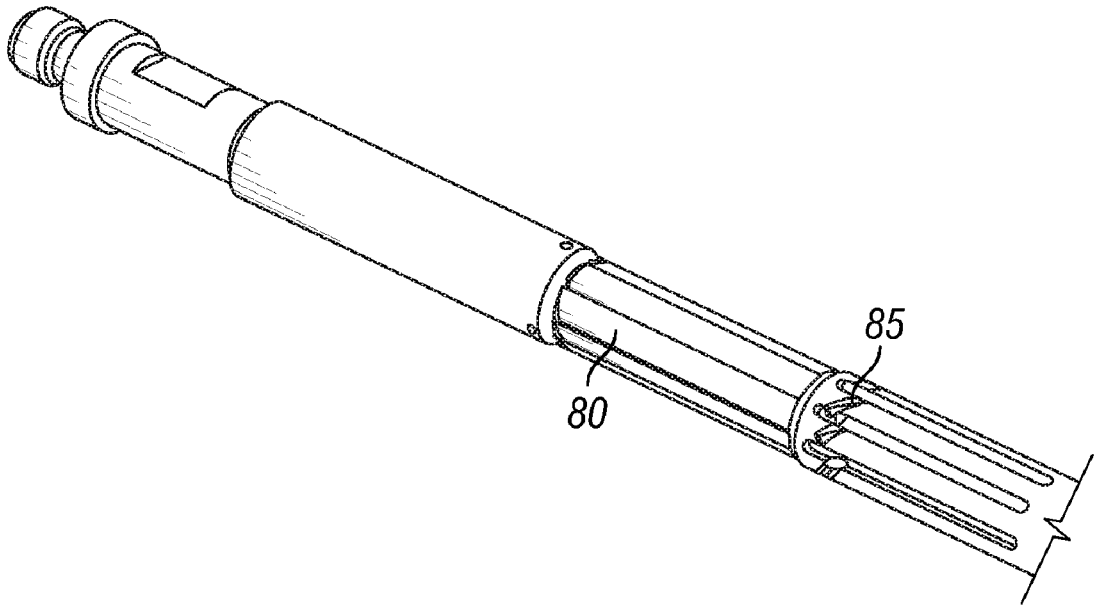

Prior to jarring, the return spring 70 holds a preload that is, for example, two times greater than the weight of the cutter 55, cutter housing 50, nose 60, central prong 15 and the jar weight. The preloaded return spring 70 is illustrated in FIG. 4A. Once jarred, the return spring 70 compresses as illustrated in FIG. 4B. When the impact is complete, the return spring 70 brings the cutter 55, cutter housing 50, nose 60 and central prong 15 back to the starting position. During the recovery, the indexing mechanism rotates the lower end of the communication tool 10 by 45 degrees for another jarring hit. In essence, the communication tool 10 works as an axial jackhammer that is designed to compromise the hydraulic integrity of the communication component of the TRSSSV.

Figure 11:
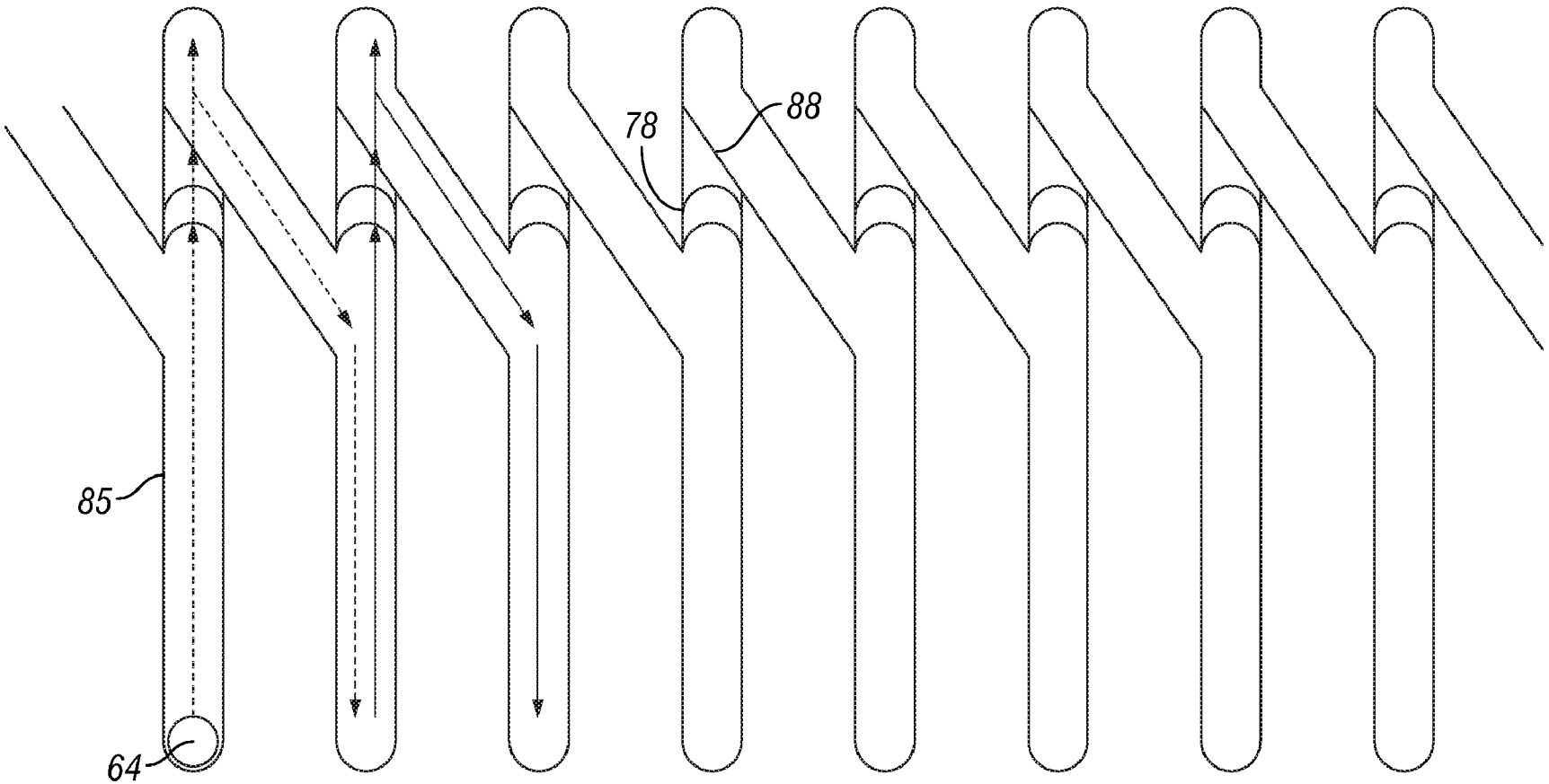
FIG. 11 illustrates the indexing profile on the central prong according to an exemplary embodiment of the present invention.

As illustrated in FIGS. 5A-5B and FIGS. 6, 6A and 6B, when central prong 15 is driven back up from the return spring 70, the index springs 65 force the central prong 15 to rotate while the ratchet springs 75 prevent any counter rotation. The indexing profiles 85 cut on the outer diameter of the central prong 15 allows each of the indexing pins 64 on the plurality of index springs 65 to track in a mating groove, the shapes of which force the central prong 15 to rotate, for example, 45 degrees with each return. Indexing springs 65 are biased radially inwardly. FIG. 11 illustrates one exemplary embodiment of indexing pin 64 and indexing profile 85. Ramps 78 and ledges 88 are formed in the indexing profile and cause the inner prong to turn relative to the rest of the tool as pin 64 tracks through the indexing profile 85. Please note, however, those ordinarily skilled in the art having the benefit of this disclosure realize there are any number of ways to accomplish the indexing function of the present invention.

Figure 6:
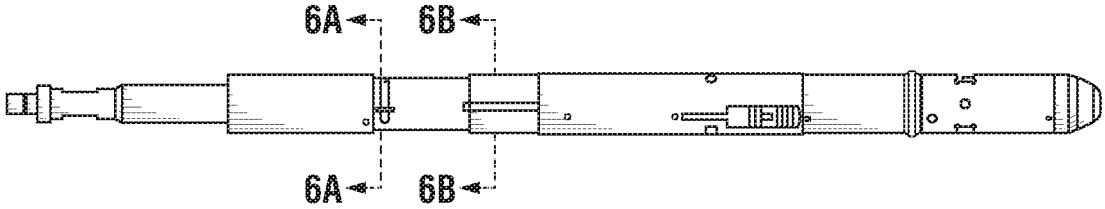
FIG. 6 shows an embodiment of the communication tool with the ratchet sleeve removed.
Figure 6A:
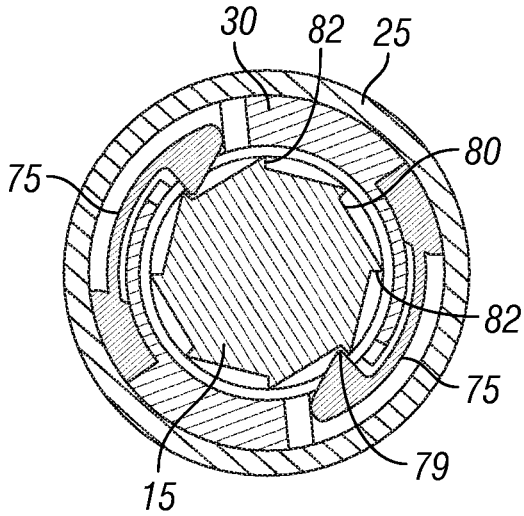
FIG. 6A shows a section view taken along the line A-A in FIG. 6.

The ratchet springs 75, as shown in FIG. 6A, keep the central prong 15 from rotating in the wrong direction. In the embodiment shown in FIG. 6A, two ratchet springs 75 are circumferentially located about central prong 15. The ratchet springs 75 are mounted to a indexing body 30 located between ratchet sleeve 25 and central prong 15. The ratchet springs 75 are biased radially inwardly. As the central prong 15 is rotated, the tip 79 of a ratchet spring will ride up the ramp of the ratchet profile 80 of the central prong 15 until it snaps over a shoulder 82 on the ratchet profile 80. The interaction of shoulders 82 and tips 79 of the ratchet spring 75 prevent clockwise rotation of central prong 15. Ratchet profile 80 includes eight profile surfaces, each one representing 45 degrees of rotation. One skilled in the art having the benefit of this disclosure will recognize that the number of surfaces will correlate to the amount of rotation desired per return (e.g., the larger the rotation the fewer the surfaces).

FIGS. 7A-7D illustrate the communication tool 10 in the running position inside of the tubing retrievable subsurface safety valve (TRSSSV) 100 according to an exemplary embodiment of the present invention. Central prong 15 extends longitudinally through the outer assembly of communication tool 10, the outer assembly including the upper housing 20, ratchet sleeve 25, lock body 35, return spring adapter 45, cutter housing 50 and nose 60. According to one exemplary embodiment, indexing body 30 is mounted inside of the lower end of upper housing 20, ratchet sleeve 25 and the upper end of lock body 35. Indexing body 30 includes indexing pins 64 on springs 65 which travel in indexing profiles 85 on the central prong.

Figure 7C:
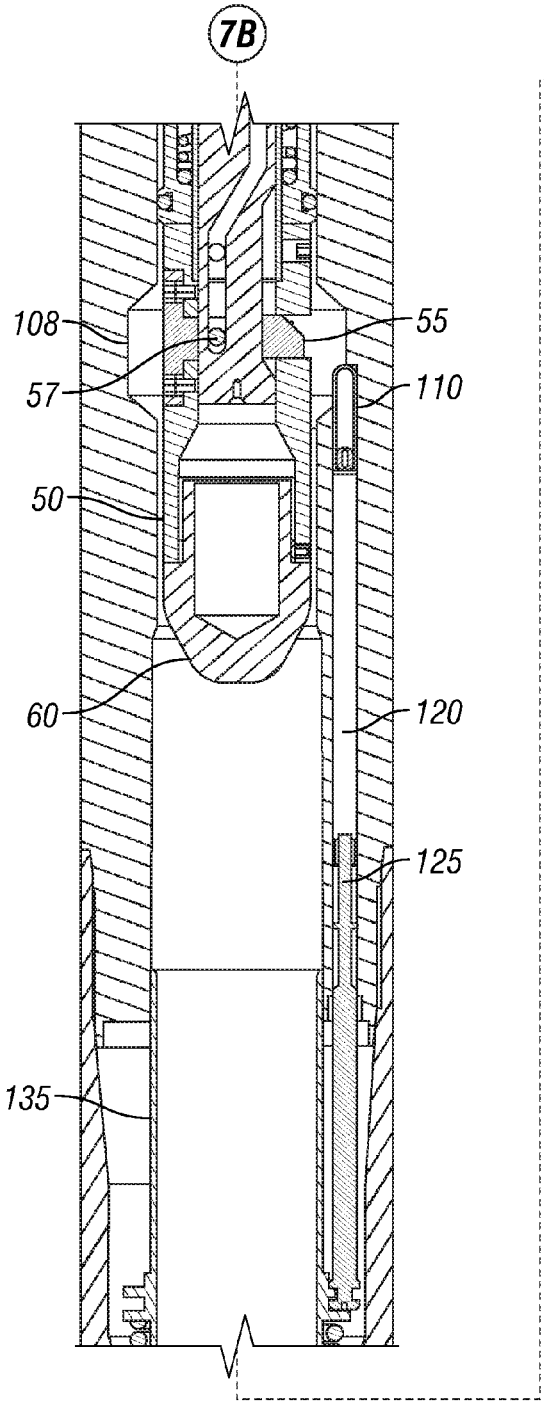
Figure 7D:
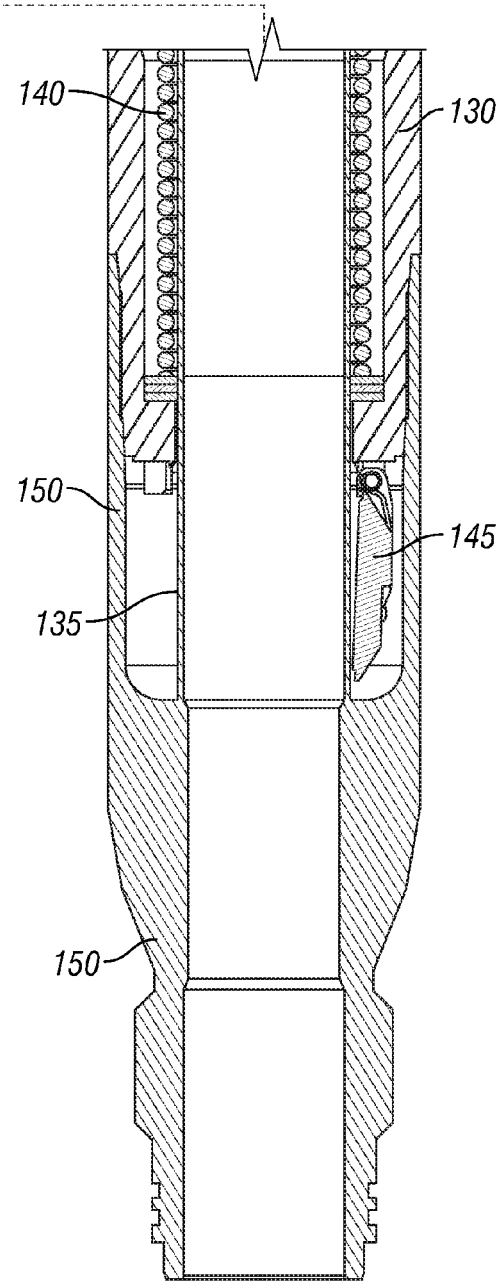

Communication tool 10 is run inside of the production tubing and into the top of TRSSSV 100 until the lock dogs 40 are positioned adjacent to a mating profile in the safety valve hydraulic chamber housing 105. In this position, cutter 55 is in the retracted position as illustrated in FIG. 7C. Cutter 55 is adjacent hydraulic chamber housing internal relief 108 which provides access to the upper end of communication component 110. The communication component 110 is in communication with piston bore 120 of the safety valve via communication retention ball 115. Retention ball 115 is press fitted inside of communication component 110, thereby retaining the component in the safety valve. Retention ball 115 includes an internal passageway which provides communication between communication component 110 and piston bore 120. Further discussion of communications component 110 will follow in conjunction with the description of FIGS. 10A-10C.

Hydraulic piston 125 is mounted inside non-annular piston bore 120 and connects to flow tube 135. Flow tube 135 may be shifted via hydraulic pressure acting on piston 125 to extend through flapper 145 to open TRSSSV 100. If hydraulic pressure is lost, power spring 140 will force flow tube 135 upwardly above flapper 145, thereby allowing flapper 145 to pivot to the closed position and to prevent flow of well bore fluids up through the safety valve. Although not shown in detail, it is understood that flow tube 135 is locked in the open position prior to the insertion of communication tool 10. Various methods of locking open the TRSSSV 100 are known.

Figure 8A:
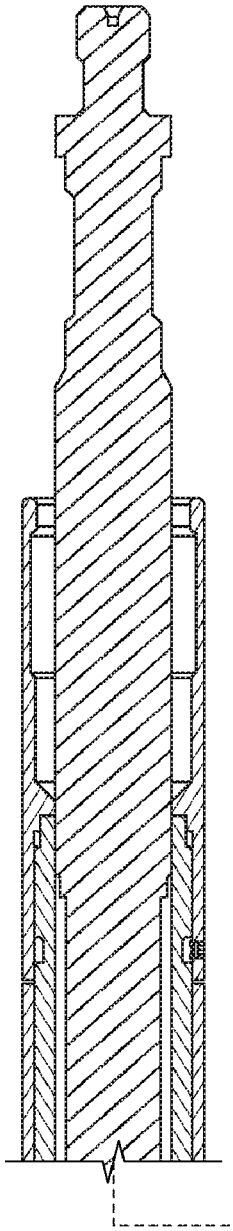
FIGS. 8A-8D show the communication tool of FIGS. 7A-7D in the pre-jarring position.
Figure 8B:
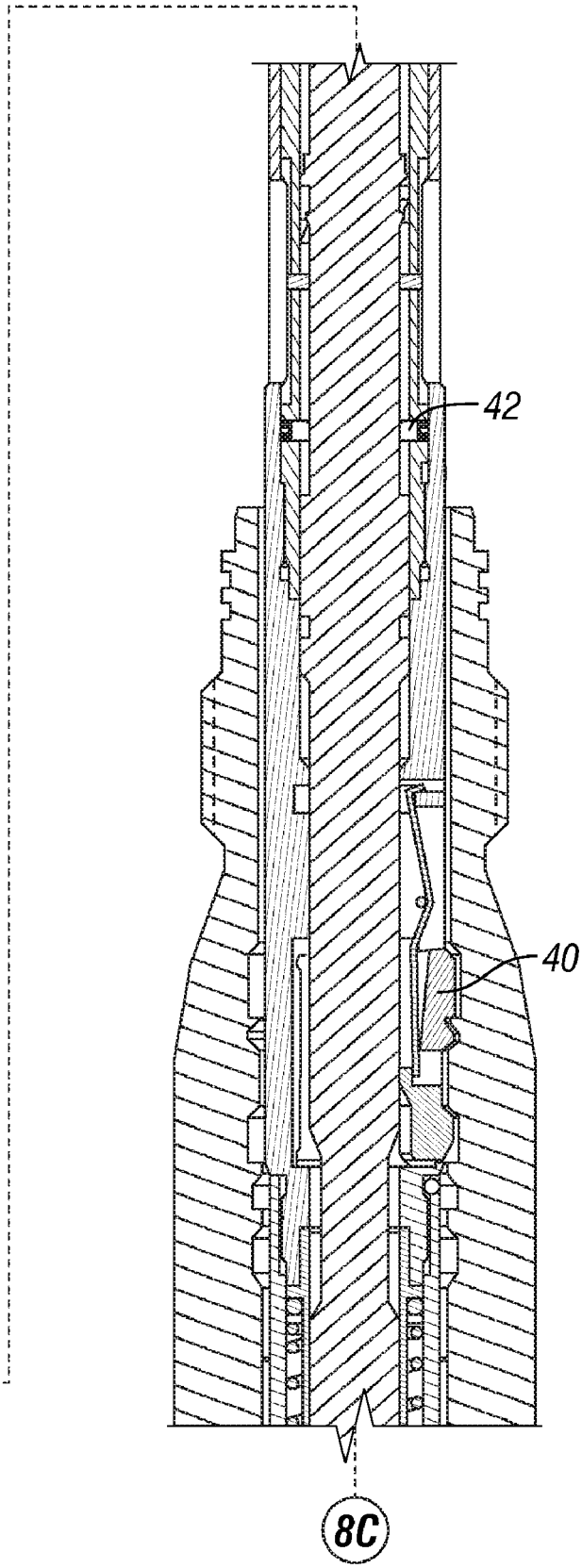
Figure 8C:
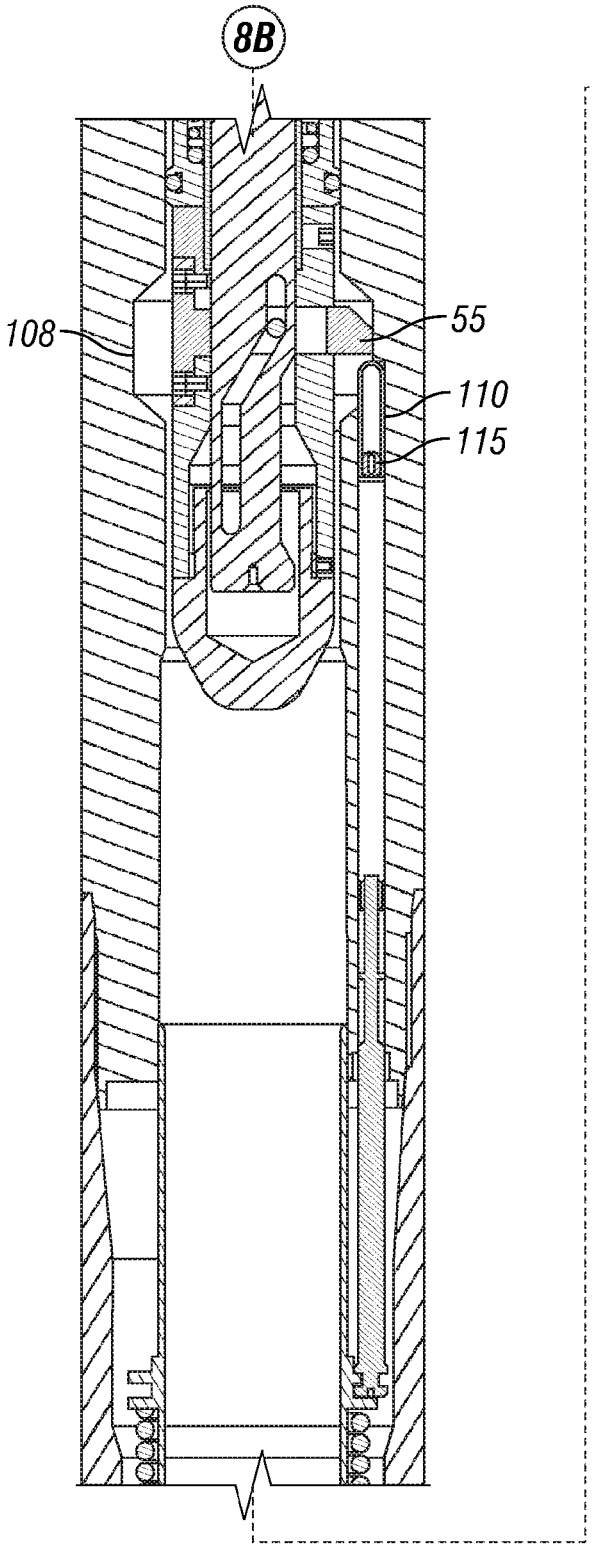
Figure 8D:
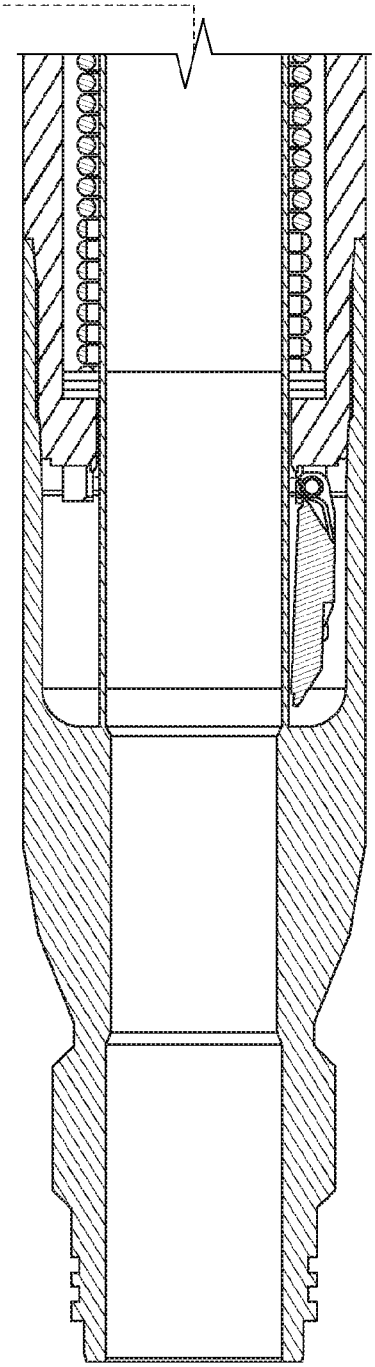

To set lock dogs 40, weight is applied to central prong 15 causing shear pins 42 to be severed thereby allowing the central prong 15 to move downwardly until an enlarged section of the central prong moves behind locking dogs 40 causing the dogs to radially extend into the mating profile in the hydraulic chamber housing 105. In this position, locking dogs 40 are set thereby locking the communication tool to the TRSSSV 100. The downward movement of a central prong 15 also causes an internal profile in the central prong 15 to move downwardly relative to cutter extension pin 57. As shown in FIG. 8C, the movement of extension pin 57 relative to the internal profile causes cutter 55 to extend into the internal recess 108 in the hydraulic chamber housing. Once locked in place, the communication tool 10 is ready for jarring to establish communications through communication component 110.

Figure 9A:
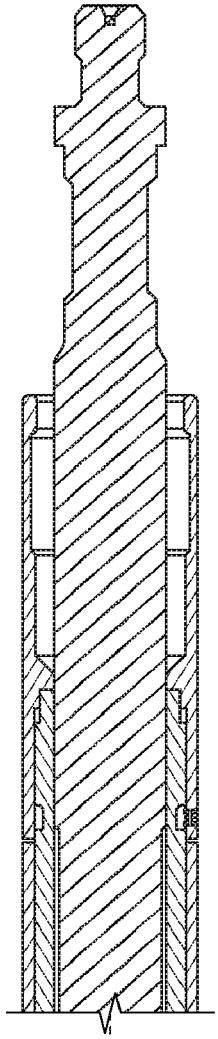
FIGS. 9A-9D show the communication tool of FIGS. 7A-7D in the jarring position.
Figure 9B:
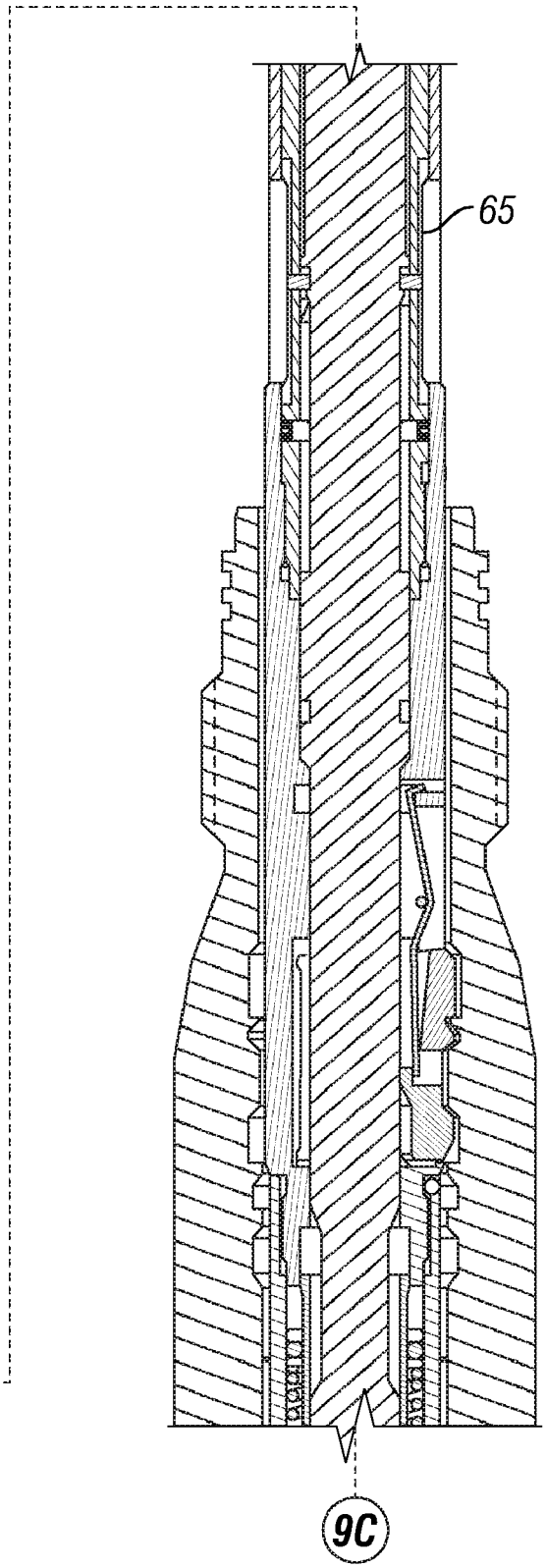
Figure 9C:
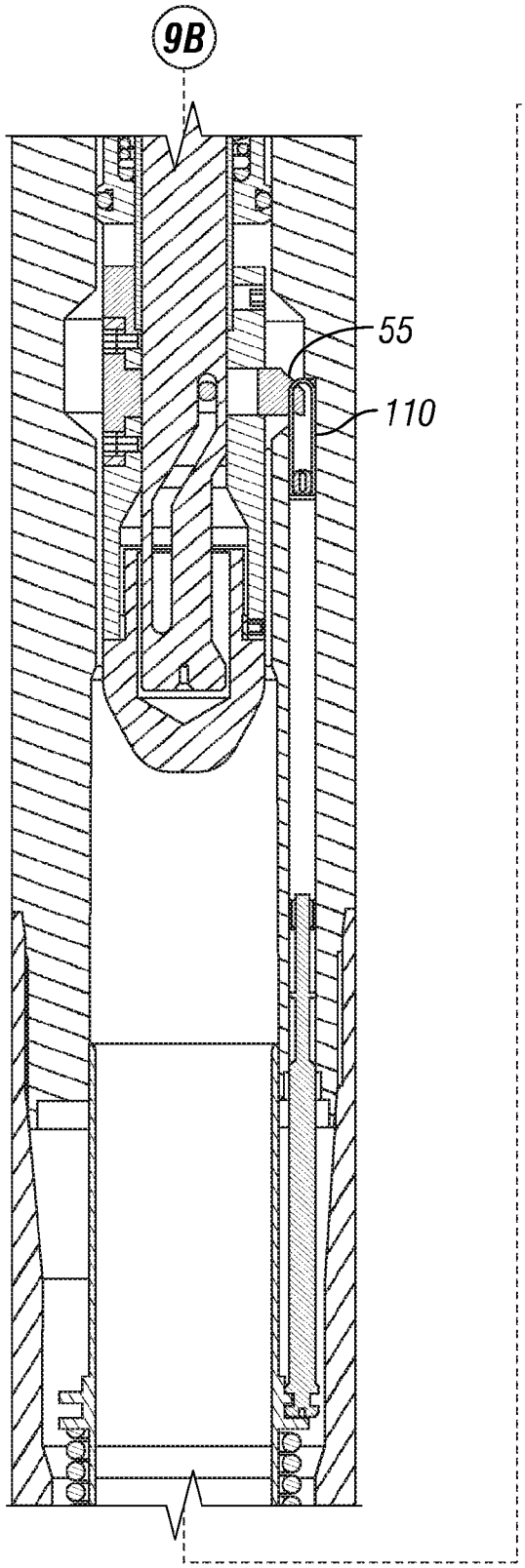
Figure 9D:
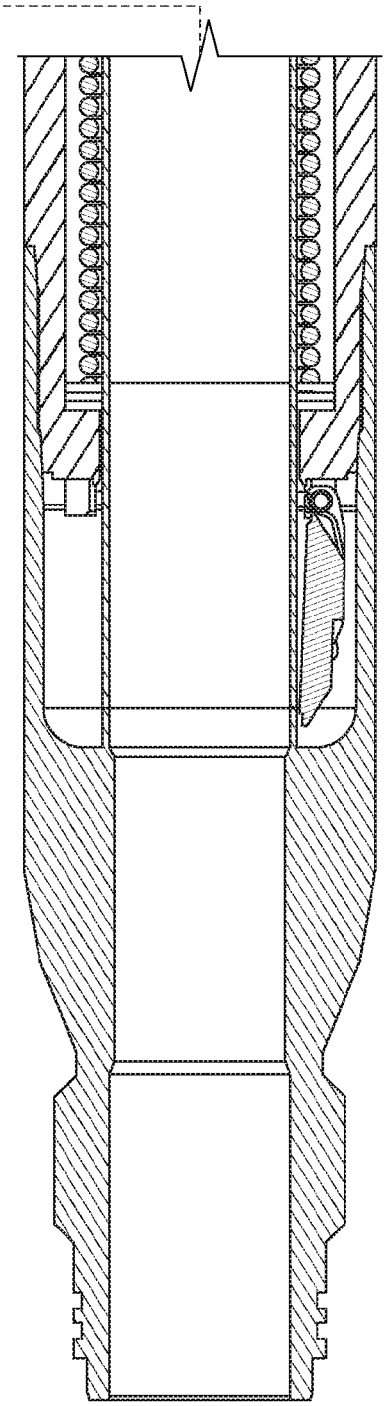

FIGS. 9A-9D illustrate the communication tool in the jarring position according to an exemplary embodiment of the present invention. Jarring on the central prong 15 will cause the prong 15 to move downwardly relative to the outer assembly of the communication tool 10 thereby causing cutter 55 to move downwardly relative to the safety valve. Should the cutter extend over the top of the communication component 110, the movement of the prong 15 downwardly will cause the cutter to compromise the integrity of the communication component 110 as shown in FIG. 9C. Once compromised, communication will be established through the communication component 110 and into the internal bore of the TRSSSV 100. Since piston bore 120 is in fluid communication with a control line that extends to the surface (not shown) the control line may be used to control a wire line subsurface safety valve subsequently installed within the internal bore of the TRSSSV 100.

Figure 6B:
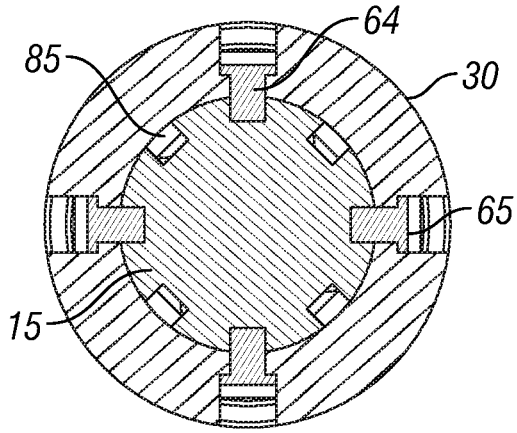
FIG. 6B is a section view taken along the line B-B in FIG. 6.

The downward movement of the central prong 15 during the jarring mode, causes return spring 70 to be compressed. More particularly, extension mandrel 71 (shown in FIG. 7B) connected about the lower end of prong 15 compresses spring 70. The downward movement of prong 15 also causes the indexing springs 65 to snap over the index profile ramps 80 as shown in FIGS. 6A and 6B. When the weight on the prong 15 is removed, the compression spring 70 pushes the central prong 15 back up and the lower portion of the tool 10 rotates 45 degrees which will allow for another jarring hit. In this way, cutter 55 will rotate 45 degrees about the radially enlarged recess 108 prior to the subsequent hit. The jarring/rotating steps will be repeated as many times as necessary until the cutter eventually extends over the communication component and it is jarred downwardly through the component. The ratchet springs 75 keep the central prong 15 from rotating in the wrong direction. Once the communication component 110 is severed, pulling up on the central prong 15 will retract the cutter and the lock dogs allowing for the communication tool 10 to be withdrawn from the TRSSSV 100 and pulled out of the hole.

Figure 10A:
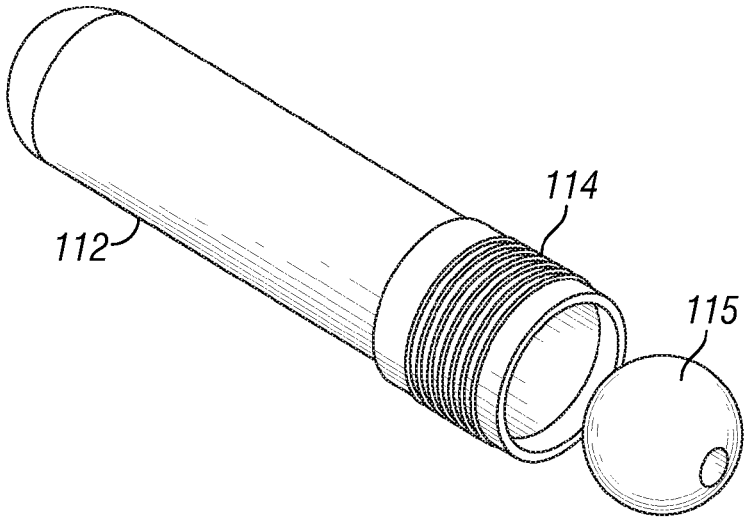
FIGS. 10A-10C show one embodiment of the communication component of the TRSSSV.
Figure 10B:
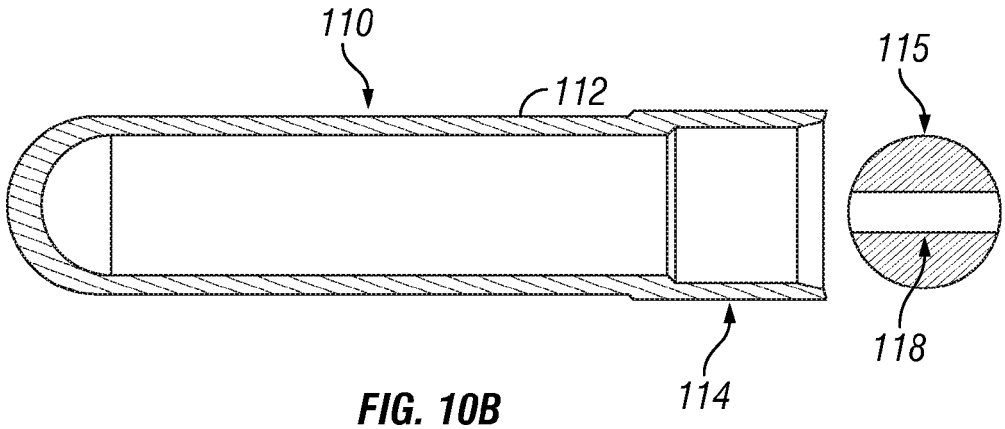
Figure 10C:
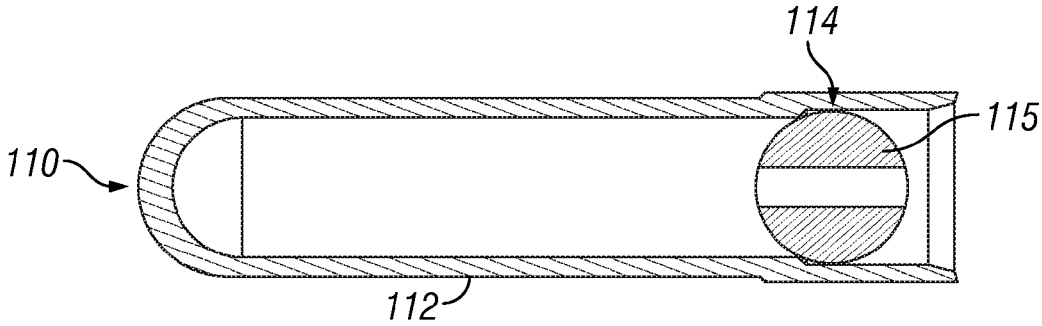

FIGS. 10A-10C show one exemplary embodiment of the communication component 110 according to the present invention. Communication component 110 comprises body 112 and communication retention ball 115. The communication component body 112 is first installed into the hydraulic conduit within the TRSSSV hydraulic chamber housing. Sealing grooves 114 are provided on the lower end of body 112. When the retention ball 115 is pressed into the communication component body, a high contact pressure, metal-to-metal seal between sealing groves 114 of body 112 and the hydraulic conduit wall is established, effectively isolating the hydraulics from the inside of the TRSSSV 100. Once the communication component is broken, the hydraulic fluid will be able to communicate through the fluid bypass passage 118 extending through retention ball 115 into the bore of the TRSSSV 100. The communication component 110 is made of a frangible material that may be cut, pierced, sheared, punctured, or the like. During normal operations of the TRSSSV 100, the communication component is protected in the sidewall of the hydraulic chamber housing. In a preferred embodiment, body 112 is made of 718 Inconel or 625 stainless steel and ball 115 is made of 316 or 625 stainless steel. Please note, however, that one ordinarily skilled in the art having the benefit of this disclosure would realize any variety of communications components, chambers, etc. could be utilized within the scope of this invention.

Although various embodiments have been shown and described, the invention is not so limited and will be understood to include all such modifications and variations as would be apparent to one skilled in the art. For example, the communication tool could be used to establish communication with other types of downhole devices (i.e., devices other than a TRSSSV). Such tools may, or may not, include a communication component through which fluid communication is established with the communication tool. Thus, the present invention is not limited to establishing communication with a TRSSSV but may be used to establish communication with other types of downhole devices. Accordingly, the invention is not to be restricted except in light of the attached claims and their equivalents.

What is claimed is:

1. A communication tool to establish fluid communication between a control line and a downhole device, the communication tool comprising:

a housing having a bore therethrough;

a central prong extending inside the bore, the central prong being adapted to actuate up or down relative to the housing;

a cutter placed along the housing, the cutter being adapted to extend from the housing and to actuate up or down; and an indexing system inside the housing which is adapted to index the extended cutter around an axis of the communication tool.

2. A communication tool as defined in claim 1, wherein the indexing system is responsive to the actuation of the central prong.

3. A communication tool as defined in claim 2, wherein the indexing system comprises:

an indexing profile along an outer surface of the central prong; and a plurality of indexing pins which track the indexing profile, thereby causing the central prong to index the cutter around the axis of the communications tool.

4. A communications tool as defined in claim 1, wherein the central prong comprises an internal profile used to force the cutter to retract into the housing or extend from the housing.

5. A communications tool as defined in claim 2, wherein the central prong comprises an internal profile used to actuate the cutter to move up or down.

6. A method to establish fluid communication with a downhole device, the method comprising the steps of:

(a) running a communications tool into the downhole device, the communications tool having a cutter along a housing of the communications tool;

(b) extending the cutter from the housing of the communications tool, the cutter being adapted to actuate up or down;

(c) actuating the extended cutter downward; and (d) rupturing a communications component of the downhole device using the extended cutter, the communications component being installed within a housing of the downhole device adjacent a bore of the downhole device, wherein step (c) further comprises the step of indexing the extended cutter around an axis of the communications tool.

7. A method as defined in claim 6, wherein step (a) further comprises the step of locking the communications tool into a selected position within the downhole device.

8. A method as defined in claim 6, wherein steps (b) and (c) are accomplished by actuating a prong on the communications tool downward.

9. A method as defined in claim 6, wherein the step of indexing the extended cutter is accomplished by actuating a prong of the communications tool upward.

10. A method as defined in claim 6, the method further comprising the steps of retracting the extended cutter into the housing of the communications tool, and removing the communications tool from the downhole device.

11. A method as defined in claim 6, wherein the step of indexing the extended cutter further comprises repeatedly actuating a prong of the communications device upward, each upward actuation indexing the extended cutter 45 degrees.

12. A method as defined in claim 6, the method further comprising the steps of:

inserting a wireline retrievable sub-surface safety valve ("WRSSSV") into the downhole device; and communicating with the WRSSSV via the ruptured communications component of the downhole device.

13. A method to establish fluid communication with a first downhole device, the method comprising the steps of:

(a) running a communications tool into the first downhole device, the communications tool having a cutter along a housing of the communications tool adapted to actuate up or down;

(b) extending the cutter from the housing of the communications tool;

(c) actuating the extended cutter downward; and (d) indexing the extended cutter around an axis of the communications tool.

14. A method as defined in claim 13, the method further comprising the step of rupturing a communications component of the first downhole device using the extended cutter.

15. A method as defined in claim 13, wherein steps (b) and (c) are accomplished by actuating a prong of the communications tool.

16. A method as defined in claim 14, the method further comprising the steps of:

removing the communications tool from the first downhole device;

inserting a second downhole device into the first downhole device; and communicating with the second downhole device via the ruptured communications component of the first downhole device.

17. A method as defined in claim 16, wherein the step of communicating with the second downhole device comprises the steps of:

passing fluid into a control line being in communication with the ruptured communications component, the ruptured communications component being installed within a housing of the first downhole device adjacent a bore of the first downhole device;

passing the fluid from the control line and through the ruptured communications component, the fluid flowing through a retention ball located inside the ruptured communications component; and passing the fluid into the second downhole device.

18. A method to establish fluid communication with a downhole device, the method comprising the steps of:

(a) running a communications tool into the downhole device, the communications tool having a cutter;

(b) laterally extending the cutter from a housing of the communications tool;

(c) indexing the laterally extended cutter around an axis of the communications tool; and (d) rupturing a communications component of the downhole device using the laterally extended cutter.

19. A method as defined in claim 18, wherein step (c) further comprises the step of actuating the laterally extended cutter downward.

20. A method as defined in claim 18, wherein step (c) further comprises the step of repeatedly actuating the prong, each actuation further indexing the extended cutter.

21. A method to establish fluid communication with a downhole device, the method comprising the steps of:

(a) running a communications tool into the downhole device, the communications tool having a cutter;

(b) extending the cutter from a housing of the communications tool in response to an actuation of the communications tool; and (c) rupturing a communications component of the downhole device using the laterally extended cutter, the rupturing being accomplished without the need to align the extended cutter with the communications component prior to actuation of the communication tool.

22. A method as defined in step 21, wherein step (b) further comprises the step of actuating the cutter up or down in response to the actuation of the communications tool.

23. A method as defined in step 22, wherein step (b) further comprises the step of indexing the cutter around an axis of the communications tool in response to the actuation of the communications tool.

24. A communication tool to establish fluid communication between a control line and a downhole device, the communication tool comprising:

a housing having a bore therethrough;

a central prong extending inside the bore, the central prong being adapted to actuate up or down relative to the housing; and a cutter placed along the housing to rupture a communications component of the downhole device, the cutter being responsive to the actuation of the central prong, the cutter being further adapted to extend from the housing, wherein the rupturing of the communications component is accomplished without a need to align the extended cutter with the communications component prior to actuation of the central prong.

* * * * *